United States Patent [19]

Zubek

[11] Patent Number: 4,761,088

[45] Date of Patent: Aug. 2, 1988

[54] CLOSURE FOR A BOTTLE FOR CORRECTING FLUID

[75] Inventor: Dieter Zubek, Neusaess, Fed. Rep. of Germany

[73] Assignee: Citius Buerotechnik GmbH, Augsburg, Fed. Rep. of Germany

[21] Appl. No.: 128,343

[22] Filed: Dec. 3, 1987

[30] Foreign Application Priority Data

Dec. 13, 1986 [DE] Fed. Rep. of Germany ..... 8633404

[51] Int. Cl.[4] ..... A45D 40/00; A45D 40/26; A46B 11/00

[52] U.S. Cl. ..... 401/122; 401/129

[58] Field of Search ..... 401/121, 122, 127, 129

[56] References Cited

U.S. PATENT DOCUMENTS

| | | | |
|---|---|---|---|
| 2,703,898 | 3/1955 | Kellett | 401/122 X |
| 3,684,387 | 8/1972 | Glenn | 401/122 |
| 4,403,624 | 9/1983 | Montgomery | 401/122 X |
| 4,671,689 | 6/1987 | Gueret | 401/122 |

*Primary Examiner*—Steven A. Bratlie

*Attorney, Agent, or Firm*—Flynn, Thiel, Boutell & Tanis

[57] ABSTRACT

A closure for a bottle for correcting fluid consists of an insert (2) of yieldable plastics material fitted in the bottle neck (1*a*) and of a brush part (7) with a brush rod (8), fitted into a closure cap (14). The insert (2) is provided with a flange (3) lying on the upper edge of the bottle neck (1*a*) and with a tubular piece (4) connected thereto, which comprises an upper, also inwardly cylindrical section (4*a*) adjoining the flange (3) and a lower cylindrical section (4*b*) projecting freely into the interior of the bottle. Both sections (4*a*, 4*b*) have approximately the same inside diameter and at the lower end of the upper section (4*a*) there are provided a plurality of tongues (5) directed obliquely downward to the axis (A) of the insert (2) from the inner wall of the cylindrical section (4*a*), between whose opposed inner ends (5*a*) is formed a circular opening (6) for the passage of the brush rod (8) and between whose outer ends (5*b*) connected to the inner wall are provided apertures (9) open to the lower cylindrical section (4*b*). Between the upper end of the brush rod (8) and a sealing flange (11) arranged at the upper end of the brush part (7) there is provided a piston like section (12), whose axial length corresponds to that of the upper cylindrical section (4*a*), whose diameter is somewhat smaller than the inner diameter of the upper cylindrical section (4*a*) and which comprises at its lower end (12*a*) an annular wiping lip (13) which lies against the inner wall of the upper cylindrical section (4*a*).

10 Claims, 2 Drawing Sheets

CLOSURE FOR A BOTTLE FOR CORRECTING FLUID

Figure 1:
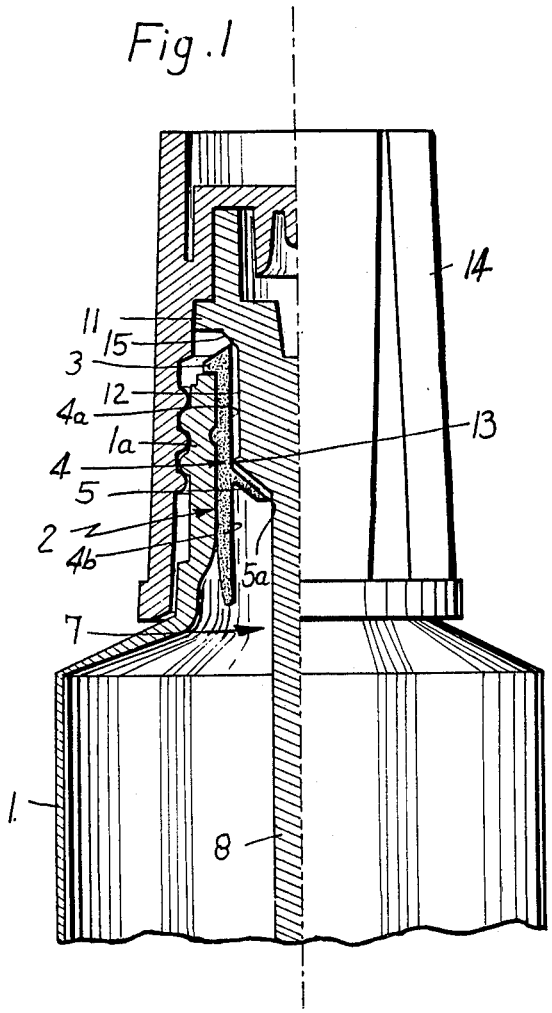

This invention relates to a closure for a bottle for correcting fluid, consisting of an insert of yieldable plastics material fitted into the bottle neck with a flange lying against the upper edge of the bottle neck and a tubular piece connected thereto, which comprises an upper, also internally cylindrical section adjoining the flange and a lower cylindrical section projecting freely into the inside of the bottle, and consisting of a brush part fitted into a closure cap, with a brush rod, in whose lower end brush hairs are inserted, and which comprises at its upper end a sealing flange cooperating with the flange of the insert.

Correcting fluids serve to obliterate typed or handwritten errors and also erroneous parts of drawings and other graphical representations. In order that the correcting fluid does not spill on inadvertent knocking over of the bottle, the above-mentioned insert is fitting into the bottle neck, which restricts the opening of the bottle neck and simulatneously also forms a component of a sealing arrangement. The constriction of the opening of the bottle neck also retards the vaporization of the solvent contained in the correcting fluid.

In a known closure for a bottle for correcting fluid of the initially mentioned kind (e.g. Tipp-Ex fluid - Registered Trade Mark) the insert comprises a conically tapering section connected to the lower end of the upper cylindrical section and to which is connected the lower cylindrical section, which has a smaller diameter than the upper cylindrical section. The opening of the insert is thereby reduced in order optimally to prevent the spilling of the correcting fluid and the vaporization of the solvent. However, when small corrections have to be effected, it is necessary to wipe the brush which takes place at the upper end of the upper cylindrical part. The wiped off correcting fluid only runs down the inner wall of the insert partially and partially dries out, especially when the brush part is not promptly reintroduced into the bottle. The drying out also takes place when the closure is not firmly screwed on. With frequent wiping of the brush the dried out correcting fluid builds ever increasingly in the insert, so that the entrance opening becomes ever more narrow and the introduction of the brush is made difficult. The brush hairs bend up in the entry so that the brush becomes bristly and fine corrections are no longer possible. With the known closure, when the closure cap is not firmly screwed on, when the bottle is tipped over some correcting fluid can also get into the insert and subsequent dry out. The dried out correcting fluid in the interior of the insert has moreover the disadvantage that it partially crumbles and falls back into the correcting fluid in the bottle or remains hanging on the brush when this is taken out. The dried out particles of the correcting fluid however for the most part do not redissolve and form unpleasant bumps in the correction. The downward tapering of the insert has moreover the disadvantage that the flowing back of the correcting fluid is made difficult by the tapering and the build-up of correcting fluid in the interior of the insert is accelerated. The correcting fluid completely or partially dried out in the insert no longer dissolves even with vigorous shaking of the closed bottle. This is attributable to the fact that the lower opening of the insert is already from the beginning relatively small in diameter, so that with the inserted brush part, only a little correcting fluid can penetrate through the annular gap between the brush rod and the lower cylindrical section of the insert. However, when the cross section of the opening is even further closed by dried out correcting fluid, even on shaking the bottle, no more correcting fluid can get to the dried out correcting fluid in the inside of the insert. The known closure has moreover the further disadvantage that correcting fluid also gets on the brush rod, dries out and gradually leads to a build up of dried correcting fluid. This dried out correcting fluid can also crumble and then lead to unpleasant bumps in the obliterations which are carried out, which also impact on the eventual correction.

The invention is accordingly based on the problem of providing a closure for a bottle for correcting fluid of the initially mentioned kind, in which a build-up of dried out correcting fluid in the insert is prevented, vaporization of the solvent is also excluded when the closure cap is only put on and not screwed up tight and finally also spilling of correcting fluid is prevented when the closure cap is not screwed up tight.

This is obtained according to the invention in that the upper and lower cylindrical sections have at least approximately the same inside diameter, in that at the lower end of the upper cylindrical section there are provided a plurality of tongues directed from the inner wall of the cylindrical section obliquely downwards to the axis of the insert, between whose opposed inner ends a circular opening is formed for the passage of the brush rod and between whose outer ends connected to the inner wall apertures are provided opening into the lower cylindrical section, and in that between the upper end of the brush rod and the sealing flange a piston like section is provided, whose axial length corresponds substantially to the axial length of the upper cylindrical section, whose diameter is somewhat smaller than the inside diameter of the upper cylindrical section, and which comprises at its lower end an annular wiping lip lying against the inside wall of the upper cylindrical section.

This wiping lip has two important functions. If the cap with the brush part is only placed loosely on the bottle, then the wiping lip engages in the upper part of the upper cylindrical section and thereby seals the underlying space in the insert and in the bottle. Thus solvent can neither vaporise from the correcting fluid in the insert nor from the bottle itself. This is particularly important in continuous use. The drying or drying out of correcting fluid in the insert is also prevented. On screwing on the closure cap the wiping lip moves downwardly in the upper cylindrical section and forces the fluid adhering to the inside wall downwardly and through the apertures between the tongues. There thus occurs an automatic cleaning of the upper cylindrical section. Correcting fluid which is forced into the lower cylindrical section drops down or mixes on shaking the bottle with the correcting fluid contained in the bottle since it has not previously dried out. The wiping lip has moreover the advantage that on completely tightening up the closure cap no correcting fluid at all can get into the upper cylindrical section. Even when the closure cap is only pushed on correcting fluid cannot get out of the insert since the wiping lip seals in all positions. The tongues projecting obliquely downwards have the purpose of narrowing the cross-sectional opening of the insert when the bottle is open and thereby retarding vaporization of the solvent. Since apertures are provided between the tongues, fluid wiped off the brush onto the inner wall of the upper cylindrical section can flow back unhindered through the apertures into the lower cylindrical section and thence into the bottle, without creating a back pressure. Moreover the tongues prevent sprays of correcting fluid getting out of the inside of the bottle when the bottle falls over. Finally the tongues inclined obliquely downward guide the brush on insertion into the bottle. Since the wiped off correcting fluid can flow through the apertures and does not have to flow through the central opening between the inner ends of the tongues, this opening can be kept so small that the inner ends of the tongues lie on the brush rod. Accordingly on withdrawing the brush rod, correcting fluid is wiped off the brush rod and retained in the bottle. In consequence no deposits of dried out correcting fluid can form even on the brush rod.

Figure 2:
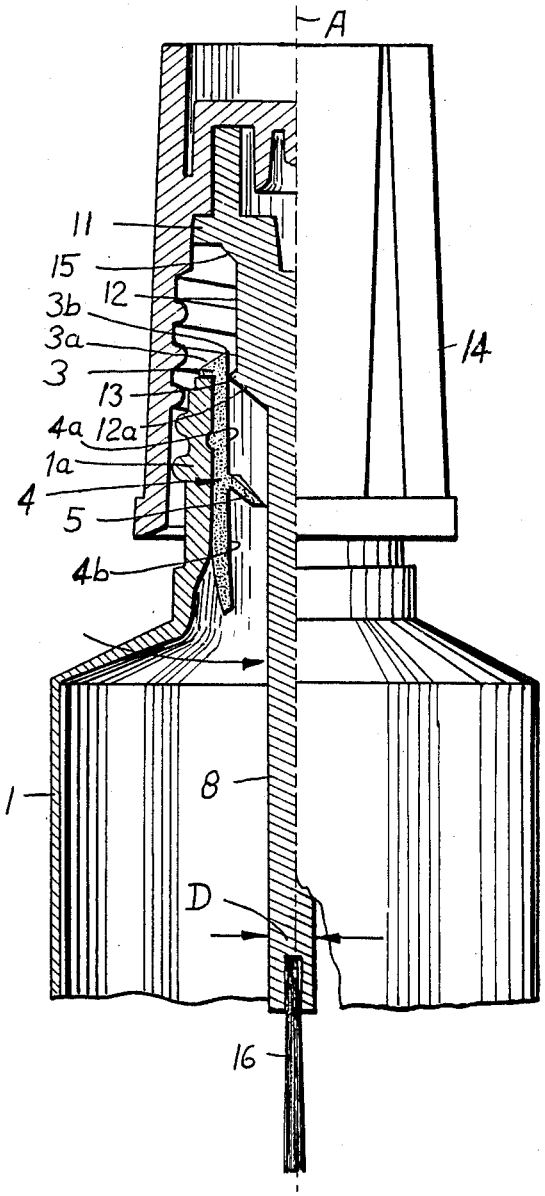
Figure 3:
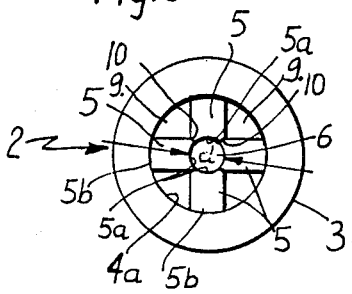
Figure 4:
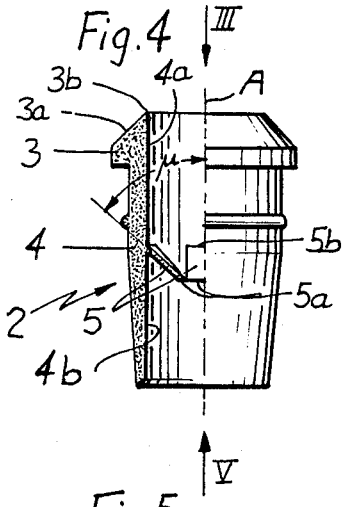
Figure 5:
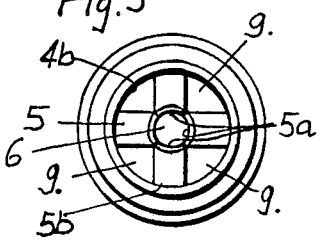

Further advantageous developments of the invention are characterised in the dependent claims. The invention will be explained in more detail below with reference to the embodiment shown in the drawings. These show:

FIG. 1 a side view of the closure, partially in longitudinal section, with closure cap fully screwed on, FIG. 2 a side view of the closure, partially sectioned, with closure cap pushed on, FIG. 3 the external appearance of the insert in the direction III of FIG. 4, FIG. 4 a side view of the insert, partially in longitudinal section, FIG. 5 the inside view of the insert in direction V of FIG. 4.

In the drawing a bottle for reception of correcting fluid is indicated at 1, in whose bottle neck 1*a* the insert 2 is fitted. This consists of yieldable and partially elastic plastics material. The insert 2 comprises a flange 3 lying against the upper edge of the bottle neck and a tubular piece 4 connected thereto. This tubular piece 4 consists of an upper tubular section 4*a* and a lower cylindrical section 4*b*, which advantageously have the same inside diameter and thus run into one another without a break. At the lower end of the upper cylindrical section there are provided four tongues 5 directed from the inside wall of the upper cylindrical section 4*a* obliquely downwards to the axis A of the cylindrical insert 2. These consist of one piece together with the remainder of the insert 2. Between the opposed inner ends 5*a* of the tongues 5 there is provided a circular opening 6 for the passage of the cylindrical brush rod 8 of the brush part 7. Between the outer ends 5*b* of the tongues 5, which are connected to the inner wall of the cylindrical section 4*a*, apertures 9 are provided. The tongues 5 advantageously are of uniform width and the apertures 9 are then sectorially formed.

The tongues 5 advantageously include an angle $\mu$ with the axis A of the insert 2 of about 45°.

In order that the tongues 5 shall effectively wipe off correcting fluid which adheres to the brush rod 8, with their inner ends 5*a*, it is advantageous for the diameter d of the opening 6 between the inner ends 5*a* of the tongues 5 to be slightly smaller than the diameter D of the brush rod, for example 0.9 mm smaller.

In order that the tongues shall have a certain yieldability during insertion and withdrawal of the brush rod, it is advantageous if the tongues 5 are separated from one another at their free ends 5*a* by cuts 10. In this manner, each tongue 5 can deflect independently of the remaining tongues.

The brush part comprises between the brush rod 8 and the sealing flange 11 a piston like section 12, whose axial length corresponds substantially to the axial length of the upper cylindrical section 4*a*. The diameter of the piston like section 12 is somewhat smaller than the inside diameter of the upper cylindrical section 4*a*. At the lower end of the piston like section 12 there is provided a wiping lip 13 lying against the inner wall of the upper cylindrical section 4*a*, which advantageously has a cross section tapering triangularly to its outer diameter.

Furthermore it is advantageous if the lower end 12*a* of the piston like section 12 adjoining the wiping lip 13 is tapered frustoconically to the brush rod 8, the angle which the conical surfaces make with the axis A of the brush rod 8 being of the same magnitude as the angle $\mu$ which the tongues 5 make with the axis A of the insert 2. In this manner, when the closure cap 14 is screwed on (FIG. 1) the space available between the frustoconically formed end 12*a* and the tongues 5 is kept very small. In order to improve the sealing effect between the sealing flange 11 and the flange 3 of the insert, the surface 3*a* of the flange 3 directed towards the sealing flange 11 rises frustoconically to the inner wall of the upper cylindrical section 4*a*, so that its intersection with the inner wall forms a sealing lip 3*b*. Moreover the transition from the piston like section 12 to the sealing flange 11 can be provided with a frustoconical section 15 on the brush part 7 cooperating with the sealing lip.

When the closure cap 14 is screwed on firmly, the parts of the closure assume the position shown in FIG. 1. The wiping lip 13 forms a first seal and prevents the possibility of correcting fluid entering the upper cylindrical section on shaking the bottle or tipping over the same. A second seal is moreover provided between the sealing lip 3*b* and the frustoconical part 15 of the brush part 7. A double seal is thereby attained which safely prevents vaporization of solvent from the correcting fluid.

To use the correcting fluid the closure cap 14 is unscrewed and pulled off. The brush part firmly fitted in the closure cap 14 is thus withdrawn from the bottle, whereby the inner ends 5*a* of the tongues wipe correcting fluid off the brush rod 8. After the withdrawal of the brush part there is thus no correcting fluid on the brush rod 8 which could flow down on to the brush 16 and the amount of correcting fluid held on the brush cannot increase. For major correcting operations the quantity of correcting fluid held on the brush is generally right. However when finer correcting operations have to be carried out, one wipes superfluous amounts of correcting fluid off on the upper edge of the insert. In this the sharp sealing lip 3*b* also acts as an accurate wiper so that excess correcting fluid can only run down on the inner wall of the upper cylindrical section 4*a* and thence through the apertures 9 and the lower cylindrical section 4*a* into the bottle. No residues of correcting fluid form on the bottle 3. If after effecting a correction the closure cap 14 is only placed loosely on the bottle neck 1*a*, then the wiping lip 14 enters as far into the upper cylindrical section 4*a* as is shown in FIG. 2. Thus remaining correcting fluid which adheres to the upper cylindrical section 4*a* is wiped down and the topmost part of the inner wall is cleaned. The wiping lip 13 however also forms a seal of the space in the insert 2 lying below the wiping lip. Consequently vaporisation of solvent is prevented and residues of correcting fluid in the insert cannot dry out. The wiping lip 13 further prevents correcting fluid getting out of the bottle and contaminating the threads on tipping over the bottle with the closure cap 14 only pushed on. When the closure cap is firmly screwed on to the bottle after completion of the work, then the wiping lip 13 moves from the position shown in FIG. 2 into the position shown in FIG. 1. It thereby wipes residues of correcting fluid from the inner wall of the upper cylindrical section and forces these residues through the apertures into the lower cylindrical section 4*b*. Insofar as the residues of correcting fluid are still runny, they then drop into the inside of the bottle. If they are however thick, they will be dissolved in the correcting fluid contained in the bottle on shaking the bottle, since they have not previously dried out. Moreover the correcting fluid contained in the bottle can easily get through the large opening of the lower cylindrical section in the region below the tongues 5 and also into the apertures 9.

The embodiments of the invention in which an exclusive property or privilege is claimed are defined as follows:

1. In a closure for a bottle for correcting fluid, consisting of an insert of yieldable plastics material fitted into the bottle neck with a flange lying against the upper edge of the bottle neck and a tubular piece connected thereto, which comprises an upper, also internally cylindrical section adjoining the flange and a lower cylindrical section projecting freely into the inside of the bottle, and consisting of a brush part fitted into a closure cap, with a brush rod, in whose lower end brush hairs are inserted, and which comprises at its upper end a sealing flange cooperating with the flange of the insert, the improvement wherein the upper and lower cylindrical sections have at least approximately the same inside diameter, wherein at the lower end of the upper cylindrical section there are provided a plurality of tongues directed from the inner wall of the upper cylindrical section obliquely downwards to the axis (A) of the insert, between whose opposed inner ends a circular opening is formed for the passage of the brush rod and between whose outer ends connected to the inner wall apertures are provided opening into the lower cylindrical section, and wherein between the upper end of the brush rod and the sealing flange a piston like section is provided, whose axial length corresponds substantially to the axial length of the upper cylindrical section, whose diameter is somewhat smaller than the inside diameter of the upper cylindrical section, and which comprises at its lower end an annular wiping lip lying against the inside wall of the upper cylindrical section.

2. The closure to claim 1, wherein the lower end of the piston like section adjoining the wiping lip tapers frustoconically towards the brush rod, the angle included between the conical surface and the axis (A) of the brush rod being of the same magnitude as the angle ($\mu$) which the tongues make with the axis (A) of the insert.

3. The closure according to claim 1, wherein the tongues make an angle ($\mu$) of about 45° with the axis (A) of the insert.

4. The closure according to claim 1, wherein the diameter (d) of the circular opening between the inner ends of the tongues is slightly smaller than the diameter (D) of the brush rod.

5. The closure according to claim 4, characterized in that the tongues (5) are separated from one another at their free, inner ends (5*a*) by slits (10).

6. Closure according to claim 1, wherein each tongue has a uniform width and the apertures between the tongues are sectorial.

7. The closure according to claim 1, wherein the upper cylindrical section and the lower cylindrical section have the same inner diameter and run into one another without a break.

8. The closure according to claim 1, wherein the wiping lip has a cross section tapering triangularly to its outer diameter.

9. The closure according to claim 1, wherein the surface of the flange of the insert directed towards the sealing flange of the brush part rises frustoconically to the inner wall of the upper cylindrical section, so that its intersection with the inner wall forms a sealing lip.

10. The closure according to claim 1, the transition from the piston like section to the sealing flange is provided with a frustoconical section on the brush part cooperating with the sealing lip.

* * * * *

UNITED STATES PATENT AND TRADEMARK OFFICE

CERTIFICATE OF CORRECTION

PATENT NO. : 4 761 088

DATED : August 2, 1988

INVENTOR(S) : Dieter ZUBEK

It is certified that error appears in the above-identified patent and that said Letters Patent is hereby corrected as shown below:

Col. 6, line 7; after "closure" insert ---according---.

Col. 6, line 21 and line 22; change "characterized in that" to ---wherein---.

Col. 6, line 22; delete "(5)".

Col. 6, line 23; delete "(5a)".

Col. 6, line 23; delete "(10)".

Col. 6, line 24; change "Closure" to ---The closure---.

Col. 6, line 39; after "claim 1," insert ---wherein---.

Signed and Sealed this

Twenty-eighth Day of March, 1989

*Attest:*

DONALD J. QUIGG

*Attesting Officer*

*Commissioner of Patents and Trademarks*